United States Patent [19]

Gilbert et al.

[11] 4,313,083

[45] Jan. 26, 1982

[54] TEMPERATURE COMPENSATED IC VOLTAGE REFERENCE

[75] Inventors: Barrie Gilbert, Forest Grove, Oreg.; Peter R. Holloway, North Andover, Mass.

[73] Assignee: Analog Devices, Incorporated, Norwood, Mass.

[21] Appl. No.: 177,470

[22] Filed: Aug. 12, 1980

Related U.S. Application Data

[63] Continuation of Ser. No. 946,326, Sep. 27, 1978, abandoned.

[51] Int. Cl.[3] ..... G05F 3/18; G05F 1/613

[52] U.S. Cl. ..... 323/350; 323/231; 323/313; 323/907; 307/263; 307/297

[58] Field of Search ..... 323/231, 233, 311-316, 323/349-350, 907; 307/263, 296 R, 297, 310, 318

[56] References Cited

U.S. PATENT DOCUMENTS

| | | | |
|---|---|---|---|
| 3,300,710 | 1/1967 | Knauss | 323/231 |
| 3,829,717 | 8/1974 | Harrison | 323/231 X |
| 3,887,863 | 6/1975 | Brokaw | 323/314 |
| 4,068,134 | 1/1978 | Tobey, Jr. et al. | 323/314 |
| 4,088,941 | 5/1978 | Wheatley, Jr. | 323/313 X |
| 4,099,115 | 7/1978 | Watanabe | 323/907 X |
| 4,110,677 | 8/1978 | Boronkay et al. | 323/313 X |
| 4,138,616 | 2/1979 | Turner | 307/310 |

FOREIGN PATENT DOCUMENTS 1459676 12/1976 United Kingdom .

*Primary Examiner*—William M. Shoop
*Assistant Examiner*—Peter S. Wong
*Attorney, Agent, or Firm*—Parmelee, Johnson, Bollinger & Bramblett

[57] ABSTRACT

A temperature-compensated IC voltage reference comprising a Zener diode serving as the principal voltage source, in combination with a compensating voltage source including a transistor providing a forward-biased junction, and control circuitry. The compensating voltage is summed with the Zener voltage to produce a reference voltage. The compensating voltage source includes an adjustment element for trimming the reference output to a specified voltage, and the control circuitry operates with that adjustment element to automatically produce optimum temperature compensation when the output has been adjusted to the specified value.

19 Claims, 3 Drawing Figures

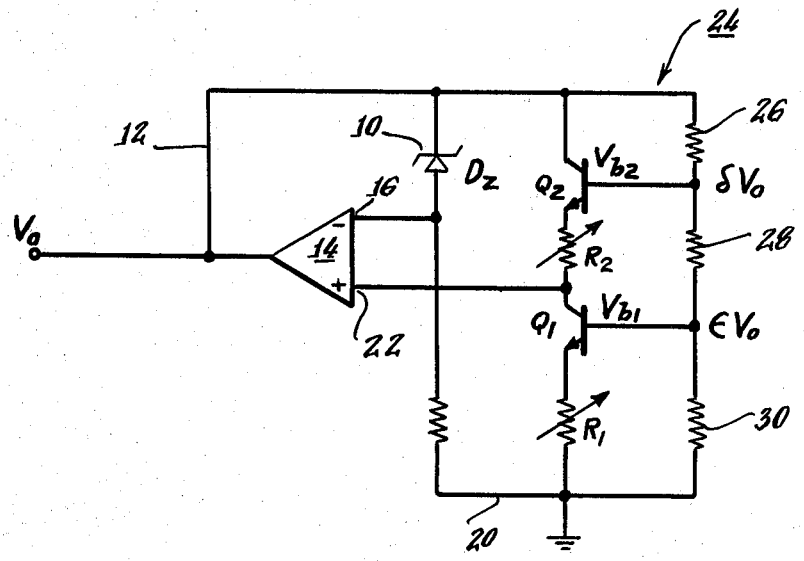
Fig. 1.
Fig. 2.
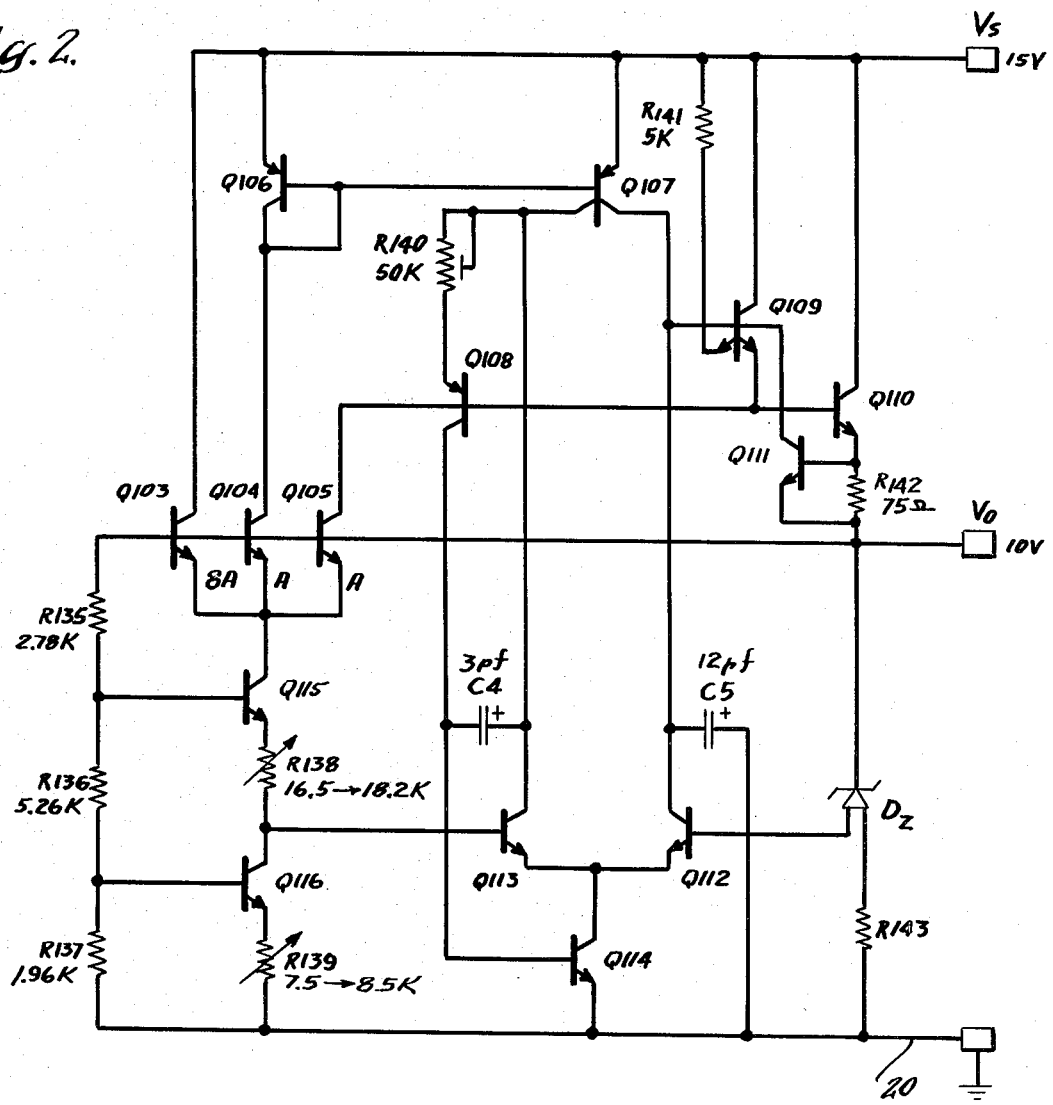

TEMPERATURE COMPENSATED IC VOLTAGE REFERENCE

This is a continuation of application Ser. No. 946,326 filed Sept. 27, 1978, now abandoned.

BACKGROUND OF THE INVENTION

1. Field of the Invention

This invention relates to solid-state voltage references. More particularly, this invention relates to improved means and methods for temperature-compensating such voltage references, and to simplified procedures by which such references may be set for optimum compensation performance.

2. Description of the Prior Art

Solid-state voltage references commonly incorporate a junction voltage source, such as a Zener, which exhibits a significant temperature coefficient requiring compensation. For many reference devices, the voltage-vs-temperature relationship can be approximated as:

$$V_{dev}=V_K+\alpha(T-T_K) \qquad \text{Eq. 1}$$

where $V_{dev}$ is the device terminal voltage at any temperture T, $V_K$ and $T_K$ are constants, and $\alpha$ is a coefficient which varies with the processing of the device.

To provide compensation for the changes in voltage with temperature, the output of such a device can be summed with a compensating voltage circuit, such as a band-gap junction source, having a temperature coefficient opposite to the original in sign (slope), and incorporating appropriate scaling to develop the specified output voltage level. The characteristics of such a compensated voltage reference device may be represented by the following relationship:

$$V_{ref}=\lambda[(V_{GO}-\beta T)\sigma+V_K+\alpha(T-T_K)] \qquad \text{Eq. 2}$$

where $V_{GO}$ is the band-gap voltage, $\beta$ is the temperature coefficient of a forward-biased junction, $\sigma$ is a proportionality factor between the voltage reference device and the compensating device, and $\lambda$ is an overall scaling factor needed to achieve a specified voltage value.

Such a device has two degrees of freedom for adjustment purposes, represented symbolically by $\sigma$ (slope) and $\lambda$ (scaling) in Equation (2) above. One procedure in adjusting the device for specified operating characteristics is to utilize a computer-operated algorithm to set $\sigma$ at the proper value to minimize temperature-induced variations for a calculated value of $\alpha$, and then adjust $\lambda$ to achieve the specified output voltage $V_{ref}$. This procedure accordingly requires two separate adjustment steps, one for each of the two degrees of freedom of the control circuit design. Experience has shown however that this procedure is undesirably complex and expensive to carry out, and although useful commercially, it is not fully satisfactory in achieving desired performance. Thus a need for significant improvement has become evident.

SUMMARY OF THE INVENTION

In accordance with an important aspect of the present invention, it has been found that importantly superior results can be achieved by a technique wherein adjustment of a single circuit element of the voltage reference is employed to simultaneously alter the two variable factors (represented by $\lambda$ and $\sigma$ in Equation 2) which control the output voltage and temperature characteristics of the voltage reference. More particularly, in a presently preferred embodiment of the invention, the adjustment of a trim resistor to bring the reference output voltage to the specified value serves concurrently to alter the temperature compensating control circuitry to provide for optimum TC at the point where the reference voltage output is equal to the specified value.

To put the matter somewhat differently, it has been discovered that the two degrees of freedom previously utilized to make the complete adjustment of each voltage reference should be reduced to a single degree of freedom, thereby to improve performance of the voltage reference and at the same time simplify the manufacturing procedures. Reducing the adjustment procedure to a single degree of freedom can be understood in a mathematical sense by considering that the variable $\lambda$ is made dependent upon $\sigma$ by the topology of the associated control circuitry for the compensating voltage source. The dependency relationship can be expressed as follows:

$$\lambda=\frac{V_{ref}}{V_K+\sigma V_{GO}-\alpha T_K} \qquad \text{Eq. 3}$$

where $V_{ref}$ is the specified output voltage.

The output voltage can then be expressed as:

$$V_{ref}=\frac{V_{ref}}{V_K+\sigma V_{GO}-\alpha T_K}[(V_{GO}-\beta T)\sigma+V_K+\alpha(T-T_K)] \qquad \text{Eq. 4}$$

The final expression becomes:

$$V_{ref}=V_{ref}\cdot\frac{\sigma V_{GO}+V_K-\alpha T_K+(\alpha-\beta\sigma)T}{V_K+\sigma V_{GO}-\alpha T_K} \qquad \text{Eq. 5}$$

where $\sigma$ is the remaining adjustable parameter.

In accordance with one important aspect of the invention, adjustment of $V_{ref}$ to the specified value simultaneously makes the term $(\alpha-\beta\sigma)$ zero, i.e. by setting $\beta\sigma=\alpha$, thus establishing the desired equality within the limits of the model.

Other objects, aspects and advantages of the invention will in part be pointed out in, and in part apparent from, the following description of the preferred embodiment considered together with the following drawings.

BRIEF DESCRIPTION OF THE DRAWINGS

FIG. 1 is a simplified circuit diagram to illustrate the basic arrangement of a preferred embodiment of the invention;

FIG. 2 is a circuit diagram showing details of a voltage reference based on the principles illustrated in FIG. 1.

DETAILED DESCRIPTION OF A PREFERRED EMBODIMENT

Figure 3:
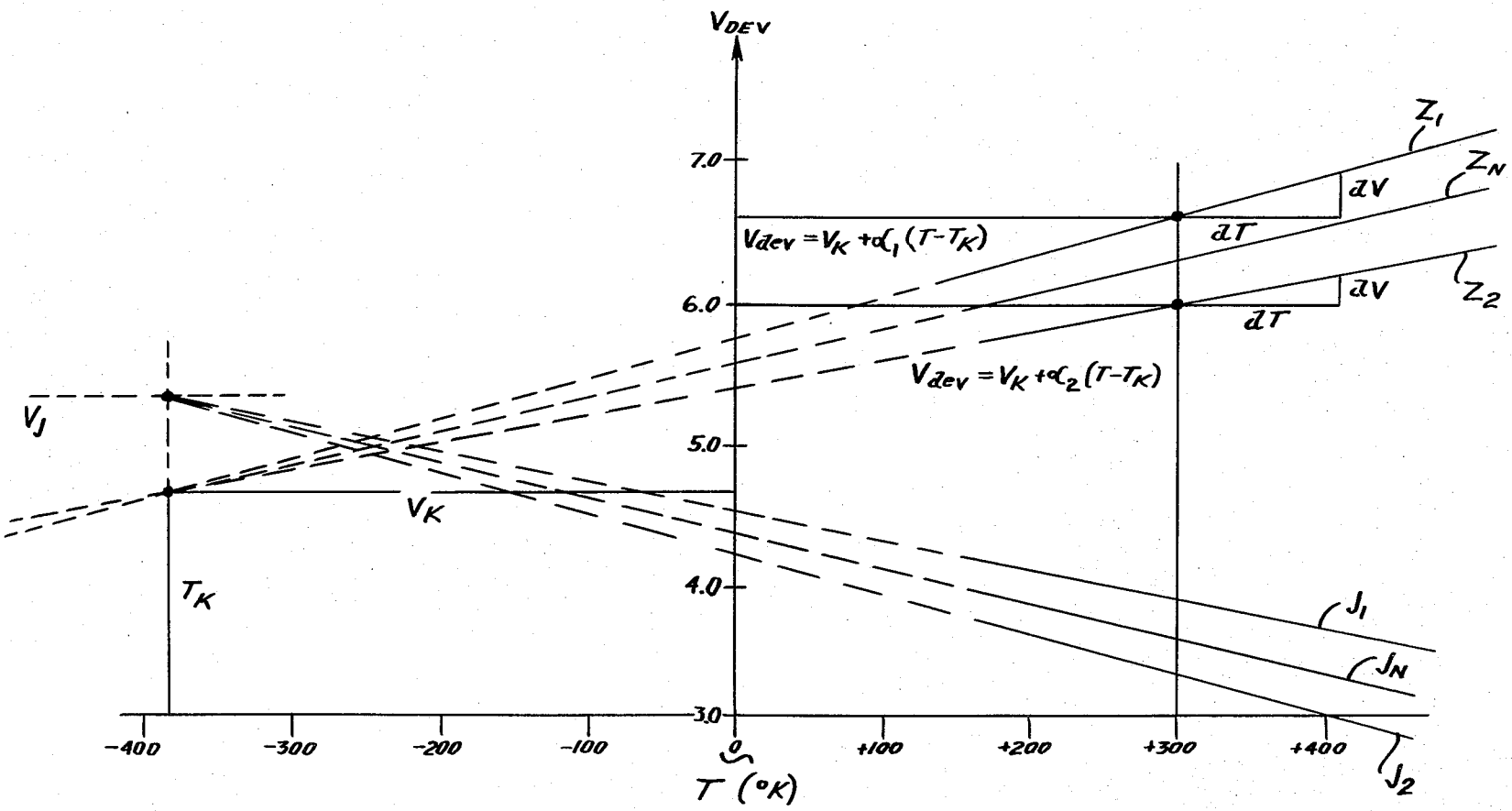
FIG. 3 is a graph showing voltage-vs-temperature characteristics of classes of voltage sources.

Turning now to FIG. 1, the voltage reference in accordance with the principles of this invention includes a Zener diode voltage source 10 with one electrode connected to the output line 12 of an operational amplifier 14. The diode is connected through a negative feedback circuit to the inverting input terminal 16 of the amplifier, which in turn is connected through a resistor 18 to a common line or ground 20.

The Zener diode 10 is formed as part of an IC chip, together with associated control circuitry as shown in FIG. 2. The chip also typically will include further circuitry (not shown) requiring the stabilized reference voltage to be developed as will be explained. Preferably, the Zener diode is formed as a buried-layer device, for example as disclosed in detail in U.S. application Ser. No. 801,410, filed on May 27, 1977, by W. K. Tsang, now U.S. Pat. No. 4,136,349, and assigned to the assignee of this application.

The potential of the non-inverting terminal 22 of the amplifier 14 is fixed by a control circuit generally indicated at 24 comprising a second voltage source means. This circuit includes series-connected matched transistors $Q_1$ and $Q_2$ each with an emitter resistor $R_1$ and $R_2$. The collector of $Q_2$ is connected to the output line 12, and the emitter resistor $R_1$ is returned to ground. A 3-resistor voltage divider 26, 28, 30 is provided to fix the base voltages of transistors $Q_1$ and $Q_2$, at predetermined levels as will be explained.

The feedback circuit of the operational amplifier 14 maintains the input terminals 16 and 22 at the same potential, so that the amplifier output voltage $V_o$ can be viewed as being the sum of the diode voltage $V_z$ and the voltage supplied to the non-inverting terminal 22. It may be noted that in the particular bridge-type of circuit shown herein, the voltage on terminal 22 also is dependent upon the output voltage $V_o$. However, such dependency is not a requirement of the invention, and other types of circuitry can be used to combine the Zener voltage with a compensating voltage.

The voltage reference output $V_o$ can be represented as a function of circuit element values and significant parameters to be discussed subsequently. A detailed derivation of the relationship is set forth in the Appendix at the end of this specification. As shown in that derivation, the output voltage can be expressed as:

$$V_o = \frac{V_z + \left(\frac{R_2}{R_1} - 1\right) V_{be}}{1 - \delta + \frac{R_2}{R_1}\epsilon} \qquad \text{Eq. 1A}$$

where $V_z$ is the Zener diode voltage, $V_{be}$ is the base-to-emitter voltage (of either $Q_1$ or $Q_2$), $\delta$ is the proportionality factor for the base voltage of $Q_2$ (i.e., $V_{b2}=\delta V_o$), $\epsilon$ is the proportionality factor for the base voltage of $Q_1$, and $R_1$,$R_2$ are resistance values.

To determine one set of relationships for zero TC, the derivative of Equation 1A can be taken with respect to temperature, and set to zero, to produce:

$$R_2/R_1 = 1 + (\alpha/\gamma) \qquad \text{Eq. 2A}$$

where $\gamma$ is defined as (d/dT) $V_{be}$ which is approximately equal to $(V_{GO}-V_{beo})/T_o$; $\alpha$, as previously described is equal to (d/dT) $V_Z$; and $V_{GO}$ is the band-gap voltage.

To develop the necessary further constraints for zero TC conditions, Equation 1A may be further elaborated as:

$$V_o = \frac{V_K + \alpha(T - T_K) + \left(\frac{R_2}{R_1} - 1\right)(V_{GO} - \gamma T)}{1 - \delta + \frac{R_2}{R_1}\epsilon} \qquad \text{Eq. 3A}$$

where $V_K$ and $T_K$ are constants (see Eq. 1 above) and T is the device temperature.

Equation 3A can be further developed through use of Equation 2A to produce:

$$V_o(\alpha) = \frac{V_K + \alpha\left(\frac{V_{GO}}{\gamma} - T_K\right)}{1 - \delta + \epsilon\left(1 + \frac{\alpha}{\gamma}\right)} \qquad \text{Eq. 4A}$$

where $V_K$, $T_K$, $\delta$, $\epsilon$ and $\gamma$ are constants.

Taking the derivative of Equation 4A with respect to $\alpha$ and setting it equal to zero yields:

$$\frac{V_{GO}}{V_K} - \gamma\frac{T_K}{V_K} = \frac{\epsilon}{1 - \delta + \epsilon} \qquad \text{Eq. 5A}$$

When this relationship is established, $V_o$ will be independent of $\alpha$. That is, the control circuitry will be effective in achieving the desired result regardless of the particular Zener diode with which it is used.

Since the parameters being established are to be valid for any $\alpha$, a still further relationship for $\epsilon$ and $\delta$ can be found by setting $\alpha=0$ in Equation 4A:

$$V_K/V_o = 1 - \Delta + \epsilon \qquad \text{Eq. 6A}$$

Equations 5A and 6A can be solved for $\epsilon$ and $\delta$:

$$\epsilon = (V_{GO} - \gamma T_K)/V_o \qquad \text{Eq. 7A}$$

$$\delta = 1 + \epsilon - (V_K/V_o) \qquad \text{Eq. 8A}$$

These relationships have been derived to provide for zero TC at the specified output voltage. However, modified relationships can, by the same techniques, be derived for other kinds of desired control of the temperature coefficient dependent upon adjusting the output voltage to a specified value. For example, there are applications requiring a specific non-zero TC at the specified reference voltage, e.g. for the purpose of matching the reference performance to another circuit characteristic. In addition, the control function described herein can be used in applications where different output voltages are required for individual units of a group, with each such output voltage having a corresponding different TC requirement. Thus, the manner in which the invention is embodied will depend upon the particular application problem to be solved.

In the case of the FIG. 1 circuit to be used to achieve zero TC, the numerical values for $\epsilon$ and $\delta$ can be obtained by inserting into Equation 7A and 8A experimentally determined values for $V_K$ and $T_K$, together with the known value of $V_{GO}$, a calculated value for $\gamma$ (using the definition in Equation 1A with a known value of $V_{beo}$), and the desired value for $V_o$. $V_K$ and $T_K$ have been determined experimentally by voltage-vs-temperature measurements on a large number of buried Zener diodes, and typical extrapolated values are: $V_K=4.74$ and $T_K = -383°$ K. The value of $V_{beo}$ is 0.655 at $T_o = 300°$ K. Using a specified value $V_o = 10$, the proportionality factors become:

$\epsilon = 0.1960$, $\Delta = 0.7220$.

Accordingly, by corresponding selection of the resistors 26, 28 and 30 to achieve base voltages $V_{b1}$ and $V_{b2}$ of 1.960 and 7.220 volts, the circuit arrangement of FIG. 1 will provide optimum temperature compensation when one or the other emitter resistor $R_1$ or $R_2$ has been adjusted to achieve the specified output voltage of 10 volts. Which resistor $R_2$ or $R_1$ is trimmed depends upon whether the initially measured output voltage is above or below 10 volts.

For an experimentally measured range of $\alpha$ for a large number of units of the class of Zener diodes produced with an IC process, as described hereinabove, the corresponding values of $R_2/R_1$ are appropriately practical. Reverting to Equation 2A, and substituting the measured range of values for $\alpha$ corresponding to measured Zener voltages of $V_z$ (at 300° K.) of 6.0 to 6.6, it is found that:

minimum $R_2/R_1 = 1.966$ (for $V_z = 6.0$), maximum $R_2/R_1 = 2.426$ (for $V_z = 6.6$).

FIG. 2 shows details of a presently preferred voltage reference incorporating the arrangement of FIG. 1, and which performs as described above. In FIG. 2, $Q_{112}$ and $Q_{113}$ form the basic elements of the operational amplifier 14. The Zener diode $D_Z$ has Kelvin connections, with force and sense electrodes essentially at the same potential. One is connected to inverting input terminal 16 and the other is connected through a resistor $R_{143}$ (reference 18 in FIG. 1) to common line 20. Transistors $Q_{115}$ and $Q_{116}$ correspond to $Q_2$ and $Q_1$ of FIG. 1, resistors $R_{138}$ and $R_{139}$ correspond to resistors $R_2$, $R_1$, and resistors $R_{135}$, $R_{136}$, and $R_{137}$ correspond to resistors 26, 28, and 30.

The amplifier circuitry of FIG. 2 is arranged with an essentially symmetrical balanced configuration. $Q_{107}$ supplies collector current to $Q_{112}$ and $Q_{113}$. The collector of $Q_{114}$ receives the emitter currents of $Q_{112}$ and $Q_{113}$, and provides adjustment to make the total current correct. The base of $Q_{114}$ is controlled through voltage translation transistor $Q_{108}$ and pinch resistor $R_{140}$ by current from the left-hand collector of $Q_{107}$.

$Q_{109}$ and $Q_{110}$ are buffer transistors. The current in $Q_{109}$ is controlled by $Q_{105}$ which is matched to $Q_{104}$ to provide for equal currents. The $Q_{104}$ current passes through $Q_{106}$ which is matched to $Q_{107}$, so that the $Q_{107}$ current and the $Q_{109}$ current will be equal, and equal to the $Q_{114}$ current. Thus, although the base currents of $Q_{109}$ and $Q_{114}$ may represent errors, such errors are balanced with respect to $Q_{112}$, $Q_{113}$, so that they tend to cancel due to the circuit symmetry.

$Q_{103}$ carries any additional current required by $Q_{115}$, $Q_{116}$. $Q_{111}$ provides protection for the output buffer $Q_{110}$. The left-hand emitter of $Q_{109}$ serves to aid start-up of the circuitry.

FIG. 3 illustrates graphically the voltage and temperature relationships discussed above with reference to FIG. 1, for achieving optimum temperature compensation through adjustment of the reference output voltage to its specified value. The presentation includes two straight lines $Z_1$ and $Z_2$ representing the outer limits of the range of variation for measured voltage-vs-temperature characteristic curves of a large number of buried Zener diodes. The slope of these lines ($\alpha_1$ and $\alpha_2$) represent the derivative of the voltage-vs-temperature relationship as discussed above. Extrapolation of these lines (and lines for intervening data, not shown) to the left results in an intersection in a common region centered about a particular voltage $V_K$ and a corresponding temperature $T_K$. (Note: For the measured data presented herein, the intersection occurs at a temperature below absolute zero, and thus has no physical counterpart, but does have conceptual significance.) With a common intersection point, and at least approximately straight-line characteristics, the voltage-vs-temperature characteristics of this Zener-diode class of voltage sources can be represented, as previously stated, as:

$$V_{dev} = V_K + \alpha(T - T_K)$$

where $\alpha$ represents the slope of each curve.

Also shown on FIG. 3 are two additional straight lines $J_1$ and $J_2$ representing limits of the range of voltage-vs-temperature characteristic curves for the voltage which is combined with the Zener voltage, and which is derived from the compensating voltage source means 24 comprising a band-gap junction. These lines also intersect at a common region, and the control circuitry of the compensating voltage source means is arranged to locate this common region at a temperature of $T_K$, i.e. on the same vertical line as the common region of intersection of the Zener characteristic curves $Z_1$ and $Z_2$. The control circuitry is further arranged to locate the common intersection at the compensating voltage $V_J$ having a magnitude such that when $V_J$ is combined with $V_K$, the composite voltage will be equal to the specified reference output voltage, i.e. in this case 10 volts.

Accordingly, with this arrangement the adjustment of the voltage reference to provide a specified output of 10 volts, by in effect changing the slope of the compensating voltage source line within the range between $J_1$ and $J_2$, will automatically result in the final adjusted slope of the curve $J_N$ having an inversely matching (i.e., complementary) relationship with respect to the slope of the characteristic curve line $Z_N$ of the particular Zener diode forming the basic source of the voltage reference. Thus, the temperature coefficient of the voltage reference will be optimized at or very near zero, as a result of trimming the output voltage to its specified value.

Although a specific preferred embodiment of the invention has been set forth hereinabove in detail, it is desired to emphasize that this is for the purpose of illustrating the principles of the invention, and is not to be considered in limitation of the scope of the invention. Thus it will be understood that the invention can be used to compensate various types of basic voltage sources, and that the compensation means can utilize various kinds of compensating voltage source means to be operated with the basic voltage source. Moreover, a wide variety of control circuits can be employed to implement the basic concepts of the invention. Accordingly, it will be appreciated that the present disclosure is provided to aid those skilled in this art in adapting the invention in various forms best suited to particular applications.

APPENDIX

Since the input terminals of the amplifier 14 are at the same potential, the following equality can be written:

$$V_o - V_z = \delta V_o - V_{be} - \frac{R_2}{R_1}(\epsilon V_o - V_{be})$$

$$V_o - \delta V_o + \epsilon \cdot \frac{R_2}{R_1} \cdot V_o = V_z - V_{be} + \frac{R_2}{R_1}, V_{be}$$

$$V_o\left(1 - \delta + \epsilon\frac{R_2}{R_1}\right) = V_z + \left(\frac{R_2}{R_1} - 1\right) V_{be}$$

Eq. 1A $$V_o = \frac{V_z + \left(\frac{R_2}{R_1} - 1\right) V_{be}}{1 - \delta + \epsilon\frac{R_2}{R_1}}.$$

$$\frac{d}{dT} V_o = \frac{1}{1 - \delta + \epsilon\frac{R_2}{R_1}}\left[\frac{dV_z}{dT} + \left(\frac{R_2}{R_1} - 1\right)\frac{dV_{be}}{dT}\right]$$

$$\frac{R_2}{R_1} - 1 = -\frac{dV_z/dT}{dV_{be}/dT} \text{ where } \frac{dV_o}{dT} = 0$$

$$\frac{R_2}{R_1} = 1 - \frac{dV_z/dT}{dV_{be}/dT}$$

let $V_z = V_K + \alpha(T - T_K)$ $$\frac{dV_z}{dT} = \alpha$$

let $V_{be} = V_{GO} - \gamma T$ $$\frac{d}{dT} V_{be} = -\gamma$$

$$\frac{dV_z}{dV_{be}} = -\frac{\alpha}{\gamma}$$

$$\frac{R_2}{R_1} = 1 + \frac{\alpha}{\gamma}$$

Eq. 2A

Substituting in Eq. 1A for $V_Z$ and $R_2/R_1$ gives:

$$V_o = \frac{V_K + \alpha(T - T_K) + \left(\frac{\alpha}{\gamma}\right)(V_{go} - \gamma T)}{1 - \delta + \epsilon\left(1 + \frac{\alpha}{\gamma}\right)}$$

expanding the numerator gives:

$$V_K - \alpha T_K + (\alpha/\gamma)V_{go}$$

so the voltage as a function of $\alpha$ is:

Eq. 4A $$V_o = \frac{V_K + \alpha\left(\frac{V_{go}}{\gamma} - T_K\right)}{1 - \delta + \epsilon\left(1 + \frac{\alpha}{\gamma}\right)} \quad V_K, T_K, \delta, \epsilon, \gamma = \text{constants}$$

Taking the derivative with respect to $\alpha$ gives:

$$\frac{dV_o}{d\alpha} = \frac{\left[1 - \delta + \epsilon + \frac{\epsilon}{\gamma}\alpha\right]\left(\frac{V_{go}}{\gamma} - T_K\right) - \left[V_K + \alpha\left(\frac{V_{go}}{\gamma} - T_K\right)\right]\frac{\epsilon}{\gamma}}{\left[1 - \delta + \epsilon\left(1 + \frac{\alpha}{\gamma}\right)\right]^2}$$

Setting the derivative equal to zero and solving yields:

$$\frac{V_{go}}{V_K} - \gamma \cdot \frac{T_K}{V_K} = \frac{\epsilon}{1 - \delta + \epsilon}$$

Eq. 5A

We claim:

1. A temperature-compensated solid-state voltage reference comprising:

first voltage source means producing a first voltage following a voltage-vs-temperature characteristic curve with a first slope;

second voltage source means producing a second voltage and combined with said first voltage to produce a composite reference output voltage responsive to said first and second voltages, said second voltage following a voltage-vs-temperature characteristic curve with a second slope;

control circuit means operable with said second voltage source means and including means controlling two independent aspects of said characteristic curve of said second voltage source means in accordance with pre-selected parameters of the control circuit means elements, one of said aspects being the slope of the curve;

said control circuit means further including adjustable means to vary said second voltage to alter correspondingly said composite reference voltage;

said control circuit means including means under the control of said adjustable means to vary said second slope as said second voltage is changed to provide, in conjunction with said pre-selected parameters, a predetermined temperature coefficient for said composite voltage when it has been adjusted to a particular specified value pre-selected from a wide range of possible values.

2. Apparatus as claimed in claim 1, wherein said control circuit means is operative to provide an effective zero temperature coefficient for said composite voltage when it reaches said specified value.

3. Apparatus as claimed in claim 2, wherein said control circuit means is operable to produce an effective inverse match between said two slopes when said composite voltage reaches said specified value, to achieve a zero temperature coefficient at that voltage.

4. Apparatus as claimed in claim 1, wherein said first voltage source means comprises a Zener diode.

5. Apparatus as claimed in claim 4, wherein said second voltage source means comprises means for producing a compensating voltage which is a function of the base-to-emitter voltage of a semiconductor junction.

6. Apparatus as claimed in claim 4, including an operational amplifier having a pair of input terminals;

means connecting said Zener diode in a negative feedback path between the output of said amplifier and one of its input terminals;

said control circuit means comprising first means connected between said output line and the other amplifier input terminal, and second means connected between said other terminal and a common line, the amplifier output voltage being a composite including the Zener diode voltage and the voltage applied to said second amplifier input terminal.

7. Apparatus as claimed in claim 6, wherein said second means comprises a transistor in series with a resistor.

8. Apparatus as claimed in claim 7, wherein said first means comprises another transistor in series with a resistor.

9. Apparatus as claimed in claim 8, including a voltage divider having a first tap point connected to the base of said first transistor and a second tap point connected to the base of said second transistor;

said adjustment means comprising one of said resistors.

10. In the art of temperature-compensating the voltage of a solid-stage voltage source by connecting thereto second voltage source means producing a second voltage so as to develop a composite reference voltage corresponding to the summation of said first and second voltages, and wherein the voltage-vs-temperature characteristic curves of said two voltages have opposite signs so that the temperature effects tend to cancel in said reference voltage;

the improved method for providing temperature compensation for a reference voltage of any specified value within a wide range of possible values, comprising the steps of:

connecting to said second voltage source means a control circuit serving to control two independent aspects of said characteristics curve of said second voltage source means in accordance with pre-selected parameters of said control circuit, with one of said aspects being the slope of the curve;

adjusting a circuit element of said control circuit so as to vary said second voltage and thereby alter said reference voltage to said specified value; and controlling through said adjustment of said circuit element the slope aspect of the characteristic voltage-vs-temperature curve of said second voltage to produce, together with the pre-selected control of the other aspect of that curve, a predetermined relationship between the effects on said composite reference voltage of the temperature characteristics of said first and second voltages so as to provide a predetermined temperature coefficient for said reference voltage when it has been adjusted to said specified value.

11. The method of claim 10, wherein said pre-selected temperature coefficient is zero.

12. The method of claim 10, wherein said first source comprises a Zener diode and said second source comprises the base-to-emitter junction of a transistor in series with an emitter resistor;

said circuit element adjustment being effected by trimming said emitter resistor.

13. The method of claim 10, wherein said two voltages are combined by connecting said Zener diode in a negative feedback path between the output and one input terminal of an operational amplifier, and connecting said second voltage source means to the other input terminal.

14. In a solid-state voltage reference device including as its basic voltage source one of a first class of elements producing a voltage which follows a voltage-vs-temperature characteristic curve with a slope differing between units of the class within a wide range, and wherein the extrapolated temperature characteristic curves of all of the units of such class pass through a common region about the graphical intersection of a particular voltage and a corresponding temperature;

compensating means coupled to said source to provide temperature compensation for said device comprising a second source producing a second voltage;

means connecting said second voltage effectively in series with said first voltage to develop a composite reference output voltage;

said second source being one of a second class of elements having an output voltage which follows a voltage-vs-temperature characteristic curve the slope of which has a sign opposite to that of the slope of the characteristic curve of said first source and wherein the extrapolated curves of the elements of the class can be controlled to pass through a common region about the graphical intersection of some voltage and temperature;

said compensating means including circuit means coupled to said second source to effect optimal temperature compensation when adjusted to produce a pre-specified composite reference voltage selected from a wide range of possible said circuit means including means to control the temperature response characteristics of said second source so that an extrapolation of the characteristic curve thereof passes through a second common region located at the graphical intersection of a pre-selected temperature and a second voltage;

said circuit means further including adjustable means to alter the slope of said characteristic curve of said second source without altering the passing thereof through said second common region, so as to provide a predetermined relationship with respect to the slope of said first source, whereby when said adjustable means has been set to produce a final output voltage of said pre-specified value, the voltage reference device wil be optimally temperature-compensated.

15. Apparatus as claimed in claim 14, wherein said basic voltage source comprises a Zener diode;

said compensating means including a transistor with a forward-biased junction and arranged to produce said second voltage responsive to changes in the transistor base-to-emitter voltage;

said adjustable means including means to adjust the current through said transistor.

16. Apparatus as claimed in claim 14, comprising a bridge circuit with two arms each having at least two series-connected circuit elements;

one of said arms including a Zener diode in series with a resistor;

the other of said arms including two series-connected transistors each with an emitter resistor;

an operational amplifier;

means connecting a point between said transistors to one of said terminals;

means connecting the other terminal between the Zener diode and its series resistor; and feedback means connecting the amplifier output to said Zener diode.

17. In the art of temperature compensating solid-state voltage sources of the type producing output voltages which follow voltage-vs-temperature characteristic curves the slopes of which vary between individual voltage source units within a wide range of values all having the same sign, and wherein the characteristic curves of all such units pass through a common region located at the graphical intersection of a particular voltage and a corresponding temperature;

the improved method comprising the steps of:

connecting to such voltage source a second voltage source producing a compensating voltage which is effectively combined with said output voltage to produce a reference voltage;

said second source voltage following a voltage-vs-temperature characteristic curve the slope of which is opposite in sign to that of the first voltage source;

coupling to said second voltage source a control circuit means including an adjustable element for altering the magnitude of said compensating voltage, thereby to change said reference voltage correspondingly, and further including means for controlling the slope of the characteristic curve and for predeterminedly setting the curve pivot location about which the slope of the curve can be varied;

adjusting said control circuit means element to produce a reference voltage of a pre-specified value selected from a wide range of possible values; and effecting through adjustment of said control circuit means element a simultaneous alteration of the slope of the voltage-vs-temperature characteristic curve of said second voltage source to produce a slope thereof which is inversely related to that of the first voltage source when said reference voltage has been adjusted to said pre-specified value.

18. In a solid-state voltage reference device including as its basic voltage source one of a first class of elements producing a voltage which follows a voltage-vs-temperature characteristic curve with a slope differing between units of the class within a wide range, and wherein the extrapolated temperature characteristic curves of all of the units of such class pass through a common region about the graphical intersection of a particular voltage and a corresponding temperature;

compensating means coupled to said source to provide temperature compensation for said device comprising a second source producing a second voltage;

means connecting said second voltage effectively in series with said first voltage to develop a composite reference output voltage;

said second source being one of a second class of elements having an output voltage which follows a voltage-vs-temperature characteristic curve the slope of which has a sign opposite to that of the slope of the characteristic curve of said first source and wherein the extrapolated curves of the elements of said second class can be controlled to pass through a common region about the graphical intersection of some voltage and temperature;

said compensating means including circuit means coupled to said second source to effect optimal temperature compensation when adjusted to produce a pre-specified composite reference voltage selected from a wide range of possible reference voltages;

said circuit means including means to control the temperature response characteristics of said second source so that an extrapolation of the characteristic curve thereof passes through a second common region located at the graphical intersection of said corresponding temperature and a second voltage which when added to said particular voltage will produce said pre-specified composite reference voltage;

said circuit means further including adjustable means to alter the slope of said characteristic curve of said second source about said second common region as a pivot point to prevent altering the passing of said curve through said second common region, said slope being alterable so as to match inversely the slope of said first source and produce a substantially zero temperature coefficient for the composite voltage, whereby when said adjustable means has been set to produce a final output voltage of said prespecified value, at any temperature, the voltage reference device will be temperature-compensated to provide a zero temperature coefficient.

19. In the art of temperature compensating solid-state voltage sources of the type producing output voltages which follow voltage-vs-temperature characteristic curves the slopes of which vary between individual voltage source units within a wide range of values all having the same sign, and wherein the characteristic curves of all such units pass through a common region located at the graphical intersection of a particular voltage and a corresponding temperature;

the improved method comprising the steps of:

connecting to such voltage source a second voltage source producing a compensating voltage which is effectively combined with said output voltage to produce a reference voltage;

said second source being of the type having voltage-vs-temperature characteristic curves the slopes of which are opposite in sign to that of the first voltage source and are adjustable about a curve pivot point;

coupling to said second voltage source a control circuit means predeterminedly setting the curve pivot location to fall on said corresponding temperature;

adjusting an element of said control circuit means to produce a reference voltage of a pre-specified value selected from a wide range of possible values; and effecting through adjustment of said control circuit means element a simultaneous alteration of the slope of the voltage-vs-temperature characteristic curve of said second voltage source about said curve pivot location to produce a slope thereof which is inversely matched to that of the first voltage source when said reference voltage has been adjusted to said pre-specified value.

* * * * *

UNITED STATES PATENT AND TRADEMARK OFFICE

CERTIFICATE OF CORRECTION

PATENT NO. : 4,313,083

DATED : January 26, 1982

INVENTOR(S) : Barrie Gilbert and Peter Holloway

It is certified that error appears in the above—identified patent and that said Letters Patent is hereby corrected as shown below:

Column 2

Eq. 3 should read as follows:

$$\lambda = \frac{V_{ref'}}{V_K + \sigma V_{GO} - \alpha T_K}$$

Eq. 4 should read as follows:

$$V_{ref} = \frac{V_{ref'}}{V_K + \sigma V_{GO} - \alpha T_K} \left[ (V_{GO} - \gamma T)\sigma + V_K + \alpha (T - T_K) \right]$$

Eq. 5 should read as follows:

$$V_{ref} = V_{ref'} \cdot \frac{\sigma V_{GO} + V_K - \alpha T_K + (\alpha - \gamma \sigma) T}{V_K + \sigma V_{GO} - \alpha T_K}$$

Column 10, line 19 After "possible" insert --reference voltages--

Signed and Sealed this

Twentieth Day of April 1982

[SEAL]

Attest:

GERALD J. MOSSINGHOFF

Attesting Officer

Commissioner of Patents and Trademarks